United States Patent [19]

Siligoni et al.

[11] Patent Number: 4,668,907

[45] Date of Patent: May 26, 1987

[54] MONOLITHICALLY INTEGRATABLE CURRENT ADDING CIRCUIT

[75] Inventors: Marco Siligoni, Vittuone; Ferdinando Lari, Bozzolo, both of Italy

[73] Assignee: SGS Microelettronica SpA, Milan, Italy

[21] Appl. No.: 806,797

[22] Filed: Dec. 9, 1985

[30] Foreign Application Priority Data

Dec. 13, 1984 [IT] Italy ..... 24022 A/84

[51] Int. Cl.[4] ..... G05F 3/10

[52] U.S. Cl. ..... 323/316

[58] Field of Search ..... 323/312, 313, 314, 315, 323/316; 363/73; 307/260, 261

[56] References Cited

U.S. PATENT DOCUMENTS 3,840,819 10/1974 Steckler ..... 323/315 X
3,952,257 4/1976 Schade, Jr. ..... 323/315 X
4,004,247 1/1977 Van de Plassche ..... 323/315 X
4,021,722 5/1977 Crowle ..... 323/316
4,550,262 10/1985 Kohsiek ..... 323/316 X

*Primary Examiner*—Peter S. Wong
*Attorney, Agent, or Firm*—Wenderoth, Lind & Ponack

[57] ABSTRACT

A monolithically integratable current adding circuit includes a current mirror circuit, the input port of which forms a first input terminal of an adding circuit and the output port of which is connected, via two series connected resistors, to a voltage reference. The point of connection between these series connected resistors forms a second input terminal of the adding circuit. The adding circuit also includes a voltage to current converter which has a first and second input terminal connected respectively to the output port of the current mirror circuit and to the voltage reference and which has an output terminal which forms the output terminal of the adding circuit.

4 Claims, 3 Drawing Figures

MONOLITHICALLY INTEGRATABLE CURRENT ADDING CIRCUIT

BACKGROUND OF THE INVENTION

The present invention relates to adding circuits for adding electrical currents and in particular to current adding circuits which may be monolithically integrated and may therefore be used in integrated circuits to generate measurement signals relating to several different current flows.

These adding circuits output a current which is equal to the sum of the currents supplied as an input thereto, or output a current which is proportional to this sum, irrespective of the polarity of the currents being input thereto.

In the case of monolithically integrated current adding circuits it is generally preferably to attenuate all of the currents which are being acted upon in order to reduce the total supply current absorption which these adding circuits require for the processing of the currents being input thereto. The simplest current adding circuit used at present in integrated circuits to form the sum of the currents of opposite sign comprises, as shown in FIG. 1, a first, a second and a third current mirror circuit M1, M2, and M3 each having an input port and an output port in which there are inserted resistors designed to calculate a constant factor of proportionality between the currents flowing in these ports. In the drawings, the current mirror circuits, which may be constructed using those techniques known to persons skilled in the art, are shown by rectangular blocks in which the input and output ports with the resistors inserted therein are also shown symbolically.

The input ports are shown by small circles.

Each resistor is shown by a number and its value, expressed by means of a constant value R and a coefficient K of predetermined value, is shown adjacent to it. The input port of the first current mirror circuit M1, in which there is inserted a first resistor 1 of value R, forms a first input terminal of the adding circuit. The output port of this circuit M in which there is inserted a second resistor 2 of value KR is connected to the input port of the second current mirror circuit M2 in which there is inserted a third resistance 3 of value KR.

The input port of the third current mirror circuit M3, in which there is inserted a fourth resistance 4 of value R forms a second input terminal of the adding circuit to which a current of opposite polarity to the current which is supplied to the first input may be supplied in accordance with the usual prior art techniques which are known to persons skilled in the art.

The output ports of the circuits M2 and M3 in which there are respectively inserted a fifth resistance 5 of value KR and a sixth resistance 6 also of value KR are connected together in a circuit node S which forms an output terminal of the adding circuit.

The adding circuit shown in FIG. 1 operates when currents having, as mentioned above, opposite polarity, for example—a current IA entering the first input terminal and a current IB being discharged from the second input terminal, are supplied to the two input terminals.

Since the ratio of resistance values between the resistors 2 and 1 is equal to K, this produces at the output port of the circuit M1 an output current IA/K which is K times lower than that of the current IA.

The current IA/K which is discharged from the current mirror circuit M2, to whose input port it is supplied, produces at the output port of this circuit an identical output current IA/K since the resistance values of the resistors 3 and 4 are the same.

The current IB also produces at the output port of the current mirror circuit M3 an output current IB/K which is K times lower than that of the current IB, since the ratio between the resistance values of the resistors 6 and 4 is equal to K.

The two currents IA/K and IB/K flowing in the circuit node S are therefore added therein, so that an output current IS=[IA+IB]/K is available at the output terminal of the adding circuit, this current being equal to the sum of th currents IA and IB multiplied by the coeffecient 1/K, and is in particular equal to the sum when K=1.

An mentioned above, it is preferable to attenuate all the currents which are being acted upon and therefore a value K which is greater that 1 is usually selected.

SUMMARY OF THE INVENTION

The object of the present invention is to provide a monolithically integratable current adding circuit which is more economically viable and guarantees greater accuracy in comparison with adding circuits of the prior art. This object is achieved with the current adding circuit set out and characterized in the claims attached to the present description.

The object may be effected by providing a monolithically integratable adding circuit for electrical currents, comprising at least one current mirror circuit having an input port and an output port which respectively contain first and second resistors which determine a constant factor of proportionality between respective currents flowing in said input and output ports, the input port of said at least one current mirror circuit being a first input terminal of the adding circuit, and further comprising a voltage to current converter having a first and a second input terminal and an output terminal, said output terminal being an output terminal of the adding circuit, and at least a third resistor having a first terminal connected to said first terminal of said converter and a second terminal connected, via a fourth resistor to a voltage reference, one of said first and second terminals of said third resistor being a second input terminal of the adding circuit, the other of said first and second terminals of said third resistor being connected to said output port of the current mirror circuit and said second input terminal of said converter being connected to said voltage reference.

The object may also be effected by providing a monolithically integratable adding circuit for electrical currents, comprising at least one current mirror circuit having an input port and an output port which respectively contain first and second resistors which determine a constant factor of proportionality between the respective currents flowing in said input and output ports, the input port of said at least one current mirror circuit being a first input terminal of the adding circuit, and further comprising a voltage to current converter having a first and a second input terminal and an output terminal, said output terminal being an output terminal of the adding circuit, said first terminal of said converter being connected to said output port of the current mirror circuit at a circuit node which is a second input terminal of the adding circuit and is connected via a resistor to a voltage reference, said second terminal of said converter being connected to said voltage reference.

BRIEF DESCRIPTION OF THE DRAWINGS

The invention is discussed in detail in the following description, given purely by way of non-limiting example, with reference to the attached drawings, in which.

Figure 1:
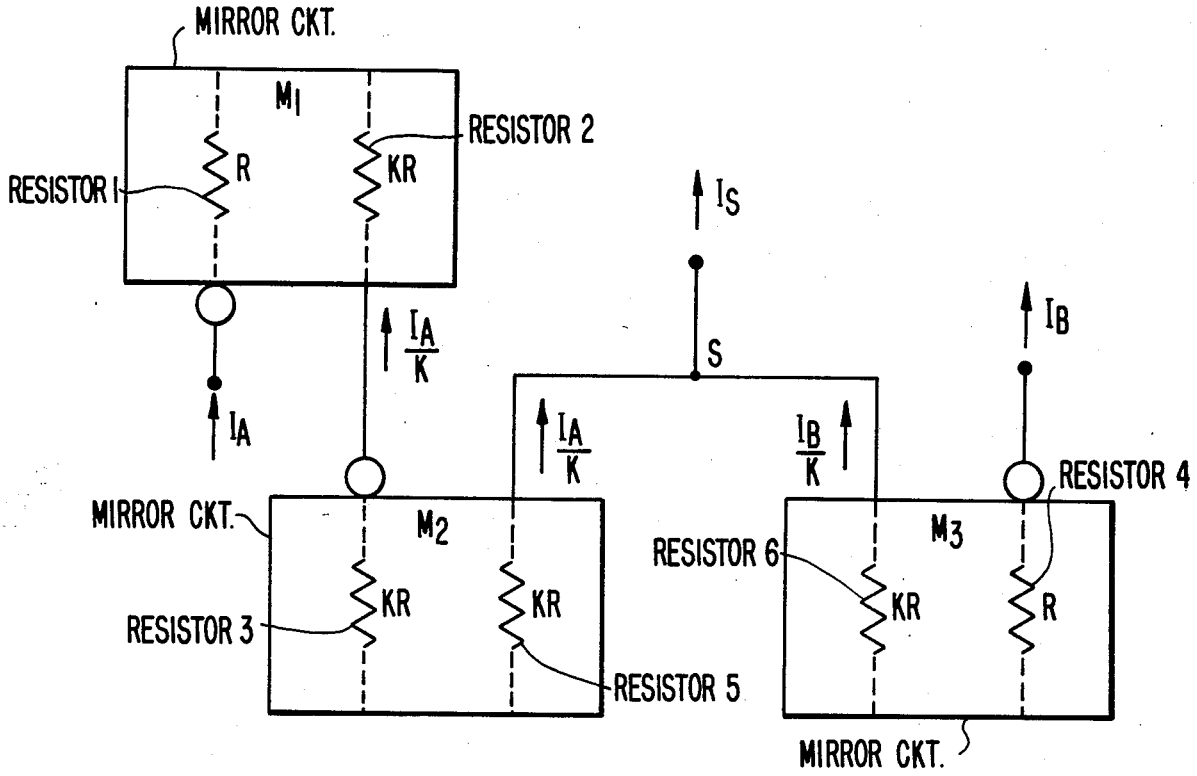
FIG. 1 is the block diagram, described above, of a current adding circuit of the prior art.

The same letters and numbers are used in the drawing figures for corresponding components.

DESCRIPTION OF THE PREFERRED EMBODIMENT

Figure 2:
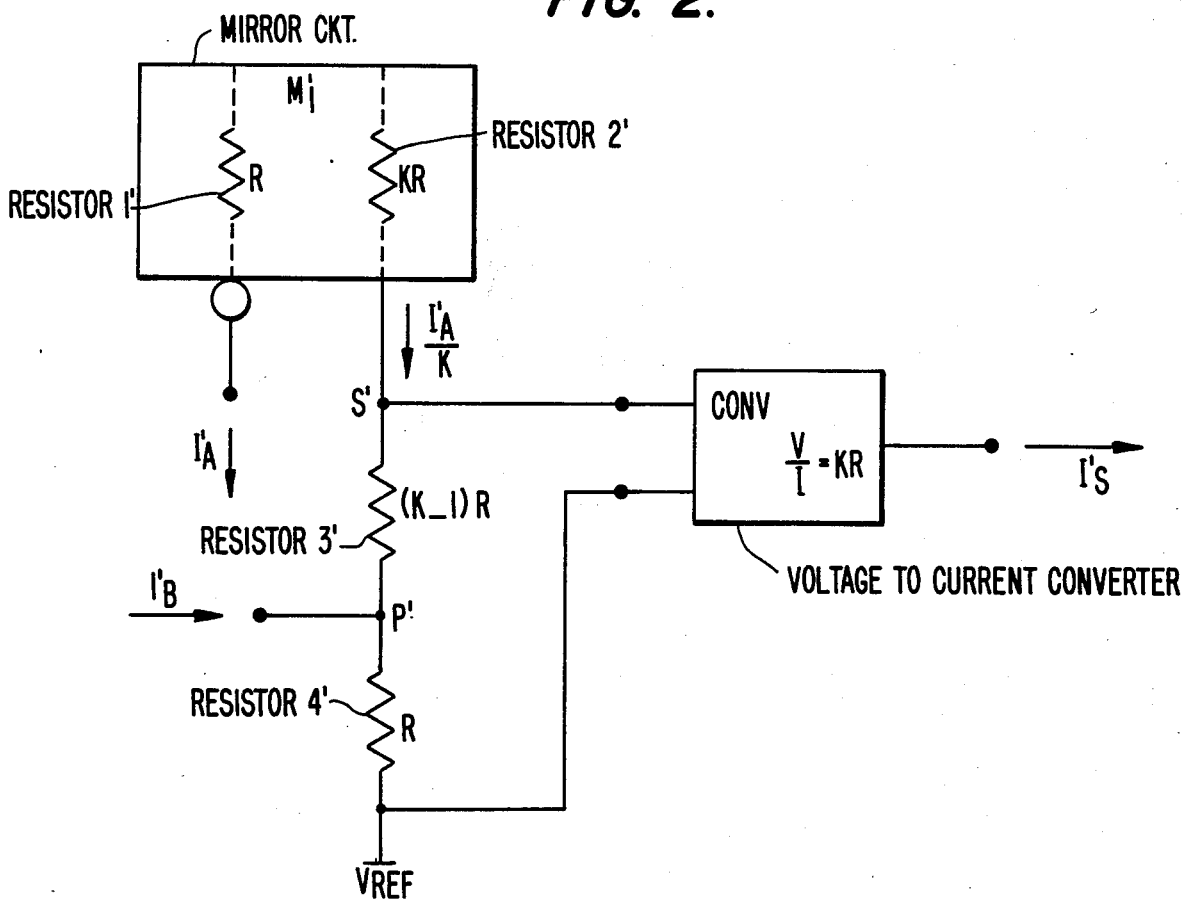
FIG. 2 is a diagram of a current adding circuit in accordance with the invention which may be monolithically integrated.

The diagram of the current adding circuit of the invention, shown in FIG. 2, comprises a current mirror circuit M'1 having an input port and an output port in which there are respectively inserted a first resistor 1' of value R and a second resistor 2' of value KR. These resistors are designed to produce a constant factor of proportionality between the currents flowing in the two ports. The symbolic representation of FIG. 1 is also used in FIG. 2 for the current mirror circuit and the resistors. The input port of the current mirror circuit M'1 forms a first input terminal of the adding circuit.

The output port of the current mirror circuit M'1 is connected to a voltage reference Vref via a third resistor 3' of value [K−1]R and a fourth resistor 4' of value R connected together in series.

The output port of the circuit M'1 is connected to the resistor 3' at a circuit node S'.

The point of connection P' between the two resistors 3' and 4' forms a second input terminal of the adding circuit.

The diagram of an adding circuit shown in FIG. 2 also comprises a voltage to current converter CONV shown by a rectangular block in which the voltage to current conversion ratio I=V/K'R of the converter itself is shown, in which the conversion factor is equal to K'R, wherein K' may or may not be the same as K. The converter CONV has a first and a second input terminal and an output terminal.

The first and the second input terminals of the converter are respectively connected to the circuit node S' and to the voltage reference Vref.

The output terminal of the converter forms an output terminal of the adding circuit.

Both the current mirror circuit M'1 and the converter CONV may be constructed using prior art techniques which are known to persons skilled in the art.

The operation of the current adding circuit of the invention, shown in FIG. 2, will now be examined, when in this case as well, there are supplied to the two input terminals currents of opposite polarities, for example a current I'A entering the first input terminal and a current I'B entering the second input terminal.

Since the ratio between the resistors 2' and 1' of the current mirror circuit M'1 is equal to K, there is produced at the output port of this circuit an output current I'A/K which is K times lower than that of the current I'A. Since, as is known to persons skilled in the art, the output impedance of a current mirror circuit such as M'1 and the input impedance of the voltage to current converter such as CONV are infinite in theory, the input current I'B may only flow via the resistor 4'. The voltage V between the circuit node S' and the voltage reference Vref is therefore:

$$V=I'A/K\,[(K-1)R+R]+I'B\cdot R=(I'A+I'B)R$$

The output current I'S from the converter available at the output terminal of the adding circuit is therefore:

$$I'=[I'A+I'B]/K'$$

since K'R is the voltage to current conversion factor.

The output current I'S is therefore proportional to the sum currents I'A and I'B in accordance with the coefficient of proportionality 1/K' and is in particular equal to this sum when K'=1.

It should be noted that in reality the current diagram of FIG. 2 only has actual physical meaning when K has a vlue of more than 1, i.e. when it is preferable to attenuate all of the currents being acted upon in order to reduce, within the scope of the invention, the supply current absorption. In the case where K=1, there is no resistor 3' so that the point P' coincides with the circuit node S'.

There could also be technical applications which require a coefficient K less than 1 such that the currents being acted upon are amplified irrespective of the value of the factor K' of the final conversion.

Figure 3:
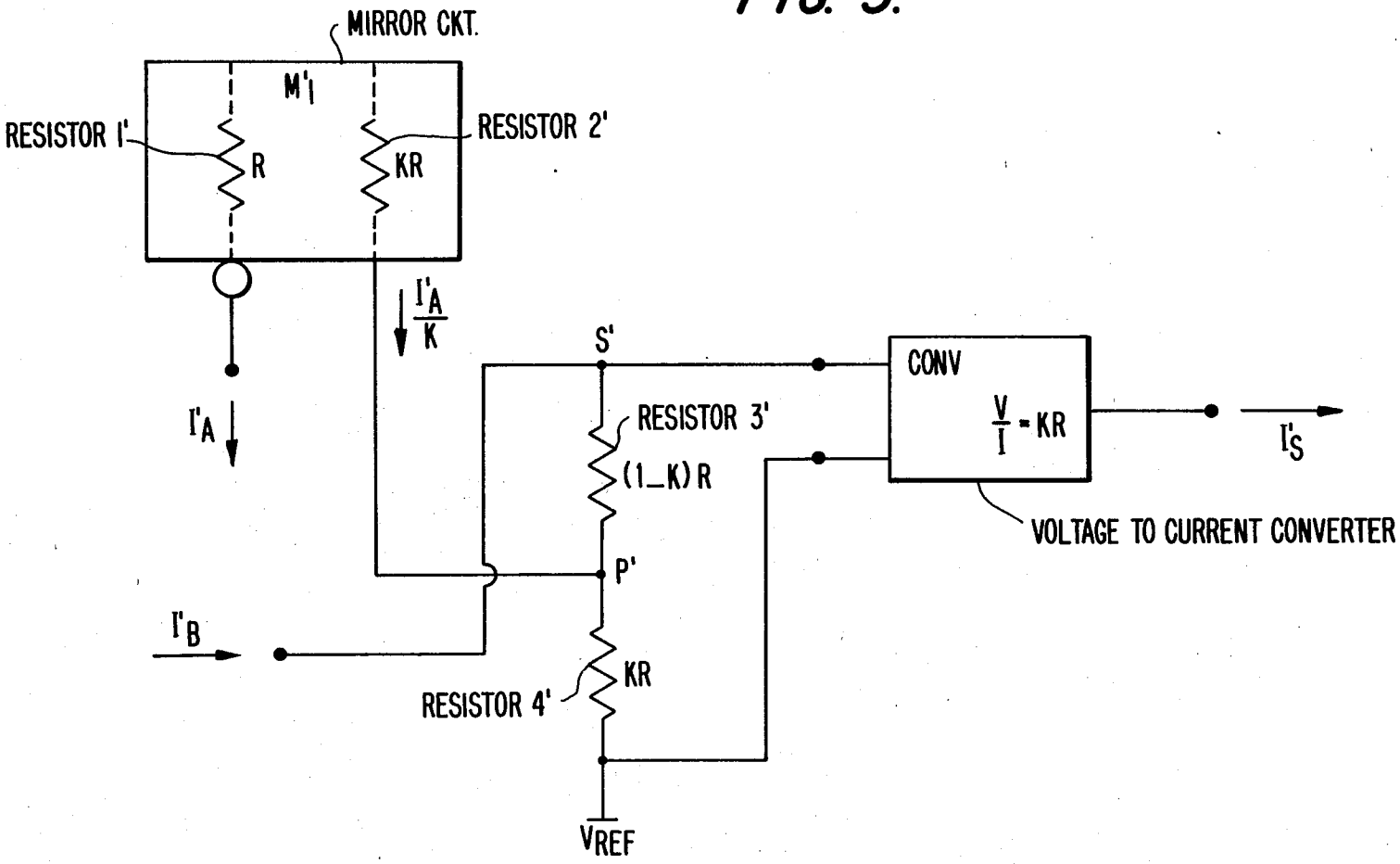
FIG. 3 is a block diagram of a different embodiment of a current adding circuit in accordance with the invention.

In this case a value (K−1)R would have no physical significance for the resistor 3' and it would then be necessary to use, for K<1, a modified circuit diagram which is shown in FIG. 3.

As can be seen, in this different embodiment of the current adding circuit which nevertheless comes within the scope of the invention, the output branch of the current mirror circuit, shown by M'1, is not connected to the circuit node S' but to the point of connection P'.

The second input terminal is formed, on the other hand, by the circuit node S'.

In this case the values of the resistors 3' and 4' are respectively (1−K)R and KR.

It can then be seen that by supplying to the input terminals two currents of opposite polarities I'A and I'B, the voltage V between the circuit node S' and the voltage reference Vref is again:

$$V=I'B\,[(1-K)R+KR]+'A/K\cdot KR=(I'A+I'B)R$$

with the result that the output of the adding circuit of FIG. 3 is the same as that of FIG. 2.

The advantages of the current adding circuit in accordance with the present invention can be seen from the fact that at present the circuit complexity of the voltage to current converter plus a voltage divider [such as the divider formed by the two resistors 3' and 4'] is more or less equivalent to that of a current mirror circuit. An adding circuit of the prior art therefore comprises at least one more current mirror circuit!

The reduced circuit complexity and the reduced occupation of integration areas which this provides consequently make a current adding circuit in accordance with the present invention more economically viable than those of the prior art.

In the case of an adding circuit embodied in accordance with FIG. 2, i.e the circuit which is generally preferable for integrated circuits, the use of resistors designed to determined predetermined current ratios is certainly more limited in comparison with that of the known circuit of FIG. 1. Bearing in mind that a resistance of value KR is absolutely necessary for the converter CONV, this only requires a resistance increase of a maximum overall value of only (3K+1)R, as against an overall value of (4K+2)R in the known circuit. Since, in integrated circuits, the provision of the resistances leads to inevitable errors in determining the ratios between the values of the resistances themselves, a reduced usage of resistances to determined predetermined current ratios provides the adding circuit of the invention with greater accuracy, although all the other parameters naturally remain the same.

Although only two embodiments of the invention have been described and illustrated, it is evident that a number of variants are possible without departing from the scope of the invention. A current adding circuit as shown in FIG. 2 or FIG. 3 could, for example, comprise any number of current mirror circuits and any number of input dividers connected together at the circuit node S' and comprising resistances having any desired predetermined values, which may be expressed by coefficients Kn which also differ from component to component in order to make it possible not only to obtain simple sums of two currents, but also linear combinations of any number of currents having any polarity. In this case an adding circuit in accordance with the present invention could be used as a current processing circuit.

We claim:

1. A monolithically integratable adding circuit for electrical currents, comprising at least one current mirror circuit having an input port and an output port which respectively contain first and second resistors which determine a constant factor of proportionality between respective currents flowing in said input and output ports, the input port of said at least one current mirror circuit being a first input terminal of the adding circuit, and further comprising a voltage to current converter having a first and a second input terminal and an output terminal, said output terminal being an output terminal of the adding circuit, and at least a third resistor having a first terminal connected to said first terminal of said converter and a second terminal connected, via a fourth resistor to a voltage reference, one of said first and second terminals of said third resistor being a second input terminal of the adding circuit, the other of said first and second terminals of said third resistor being connected to said output port of the current mirror circuit and said second input terminal of said converter being connected to said voltage reference.

2. A current adding circuit as recited in claim 1, wherein the terminal of said third resistor which is connected to said output port of said current mirror circuit is said first terminal of said third resistor and wherein the resistance value of said third resistor is substantially equal to the difference in value between the resistance values of said second and first resistors and the resistance value of said fourth resistor is substantially equal to the resistance value of said first resistor.

3. A current adding circuit as recited in claim 1, wherein the terminal of said third resistor connected to said output port of said current mirror circuit is said second terminal of said third resistor and wherein the value of said third resistor is substantially equal to the difference in value between the resistance values of said first and second resistors and the resistance value of said fourth resistor is substantially equal to the resistance value of said second resistor.

4. A monolithically integratable adding circuit for electrical currents, comprising at least one current mirror circuit having an input port and an output port which respectively contain first and second resistors which determine a constant factor of proportionality between the respective currents flowing in said input and output ports, the input port of said at least one current mirror circuit being a first input terminal of the adding circuit, and further comprising a voltage to current converter having a first and a second input terminal and an output terminal, said output terminal being an output terminal of the adding circuit, said first terminal of said converter being connected to said output port of the current mirror circuit at a circuit node which is a second input terminal of the adding circuit and is connected via a resistor to a voltage reference, said second terminal of said converter being connected to said voltage reference.

* * * * *